United States Patent [19]

Theurer et al.

[11] Patent Number: 4,955,302

[45] Date of Patent: Sep. 11, 1990

[54] MOBILE TIE GANG APPARATUS

[75] Inventors: Josef Theurer, Vienna; Johann Hansmann, Klosterneuburg, both of Austria

[73] Assignee: Frans Plasser Bahnbaumaschinen-Industriegesellschaft m.b.H., Vienna, Austria

[21] Appl. No.: 380,703

[22] Filed: Jul. 13, 1989

Related U.S. Application Data

[63] Continuation of Ser. No. 165,511, Mar. 8, 1988, abandoned.

[30] Foreign Application Priority Data

Jul. 23, 1987 [AT] Austria ..... 1871/87

[51] Int. Cl.[5] ..... E01B 29/10

[52] U.S. Cl. ..... 104/7.2; 104/9

[58] Field of Search ..... 104/2, 7.1, 7.2, 8, 104/6, 9, 3, 10, 12

[56] References Cited

U.S. PATENT DOCUMENTS

| | | | |
|---|---|---|---|
| 3,294,033 | 12/1966 | Blix et al. . | |
| 4,133,266 | 1/1979 | Taylor | 104/9 |
| 4,175,902 | 11/1979 | Herzog et al. . | |
| 4,190,394 | 2/1980 | Herzog et al. . | |
| 4,253,398 | 3/1981 | Theurer et al. . | |
| 4,301,738 | 11/1981 | Theurer . | |
| 4,418,625 | 12/1983 | Allmer . | |
| 4,534,295 | 8/1985 | Theurer . | |
| 4,579,060 | 4/1986 | Nameny et al. . | |
| 4,611,541 | 9/1986 | Theurer . | |
| 4,809,614 | 3/1989 | Theurer et al. | 104/9 X |
| 4,862,806 | 9/1989 | Theurer et al. | 104/9 X |

FOREIGN PATENT DOCUMENTS

| | | | |
|---|---|---|---|
| 2230202 | 8/1973 | Fed. Rep. of Germany . | |
| 91209 | 8/1978 | Japan | 104/9 |
| 805075 | 11/1958 | United Kingdom | 104/2 |

OTHER PUBLICATIONS

Railway Track & Structures (RT & S) (02/89), and now-continuous-action, selective tie renewal, pp. 28-32.

"Progressive Railroading", Feb. 78, p. 68; Mar. 84, pp. 93/4; Feb. 86, pp. 45/6.

"Railway Track Structures", Dec. 68, pp. 14-16; Jun. 78, pp. 28, 29 & 31; Nov. 83, pp. 22-24; Sep. 85, pp. 49, 64, 58, 61, 66, 105 & 106.

*Primary Examiner*—Joseph F. Peters, Jr.
*Assistant Examiner*—Virna L. Mojica
*Attorney, Agent, or Firm*—Kurt Kelman

[57] ABSTRACT

A mobile apparatus for sequentially exchanging selected consecutive groups of oil ties in an existing railroad track for groups of new ties while retaining groups of old ties therebetween to support the mobile apparatus on the track, comprises at least one bridge-like work vehicle having a frame defining an upwardly recessed portion between respective ends thereof, and a succession of different individual devices mounted in the recessed frame portion of a respective work vehicle and operative to effectuate different sequential operations for exchanging the selected old ties for the new ties, the tie exchanging devices including at least two tie pulling and inserting devices arranged for longitudinal displacement within view of an operator's accommodation. A respective drive displaces each tie pulling and inserting device with respect to the work vehicle frame along a displacement path extending in the direction of the longitudinal extension of the work vehicle frame.

4 Claims, 2 Drawing Sheets

MOBILE TIE GANG APPARATUS

CROSS-REFERENCE TO RELATED APPLICATION

This is a continuation of our copending U.S. patent application Ser. No. 165,511, filed Mar. 8, 1988 now abandoned.

BACKGROUND OF THE INVENTION

1. Field of the Invention

The present invention relates to a mobile apparatus or machine combination for sequentially exchanging selected consecutive groups of old ties in an existing railroad track, for example every third or fourth tie of the track or groups of, say, three adjacent old ties, for groups of new ties while retaining groups of, say, three adjacent old ties therebetween to support the mobile apparatus on the track, by means of a succession of different individual devices operatively coordinated to effectuate different sequential operations for exchanging the selected old ties for the new ties. Preferably, this apparatus is combined with a train for loading, transporting and unloading the ties on, in and from open top railroad cars.

2. Description of the Prior Art

U.S. Pat. No. 4,253,398, dated Mar. 3, 1981, discloses a mobile apparatus for the continuous sequential replacement of all old ties of a track with a track renewal train which removes the old ties and lays the new ties while the track rails are lifted and spread apart.

U.S. Pat. No. 4,611,541, dated Sept. 16, 1986, discloses a continuously advancing ballast cleaning machine with tie replacement devices, wherein the ballast is excavated, cleaned and returned while the track is raised a substantial amount. The tie pulling and inserting devices are mounted between the swivel trucks supporting the respective ends of the ballast cleaning machine frame and are connected to longitudinal displacement drives. These devices are used only when an obstacle hindering the operation of the ballast excavating chain is encountered on the shoulder of the track, i.e. they are merely auxiliary means in the ballast cleaning machine for occasional use. No control or control cab for operation of the auxiliary tie replacement devices is indicated.

U.S. Pat. No. 4,301,738, dated Nov. 24, 1981, discloses an apparatus for the replacement of track rails, which comprises two successive work vehicles with projecting, cantilevered machine frame portions. The leading work vehicle carries longitudinally displaceable tools for pulling spikes and devices for lifting and spreading the rails as well as a vertically adjustable receptacle, including a magnetic drum, for the pulled spikes. The trailing work vehicle carries a crib broom, a device for placing and inserting tie plates and a tool for driving the spikes into the ties. The machine has no means for replacing some or all of the ties.

German patent No. 2,230,202, of Aug. 16, 1973, discloses a device for clearing ballast from a track bed. This ballast removing device or scarifier comprises plate-shaped ballast clearing and planing tools which are vertically and laterally adjustably mounted on a cantilevered front portion of the machine frame. The ballast removing plates are preceded by a longitudinally displaceable push rod which may be driven to push a respective tie whose fastening elements have been slightly loosened to enable the ballast removing plates to push the ballast under the displaced tie towards the track shoulder.

It is also known, and has been widely practiced, to exchange only groups of ties in an existing track, for example every third or fourth tie or groups of adjacent ties between ties retained in the track to enable the same to support rolling stock traveling thereover, which is the technology to which the present invention relates. Such a partial tie exchange or renewal is repeated every few years until all the ties of the track have been replaced. Such a mechanized tie gang has been described on pages 22 to 24 of "Railway Track and Structures", November 1983. This mechanized tie gang comprises up to 24 pieces of equipment, such as tie cranes, spike pullers, tie shears, tie cranes for handling tie butts, rotary scarifiers, tie injectors, tampers, rail lifts, spikers and ballast regulators. In the operation of this tie gang, the old ties are withdrawn and placed on the shoulders of the track after optionally being sawn into chunks and they are then loaded onto railroad cars. The new ties are placed on the track shoulders for insertion. The loading and unloading of the ties may be effected at a different time than the tie exchange operation.

The mobile tie exchange apparatus comprises a succession of coordinated and different individual devices operative to effectuate different sequential operations for exchanging the selected ties, such as tie exchange operating devices equipped for pulling spikes, removing old tie plates, withdrawing old ties, scarifying the ballast, inserting new ties, placing new tie plates and driving new spikes. These tie exchange operating devices are suitably spaced from each other in the direction of the railroad track for coordinated operation. Some of such devices are shown in the September 1985 issue of "Railway Track and Structures", including the tie remover/inserter described and illustrated on pages 49 and 64, the self-propelled tie saw on page 58, the spike puller and hydraulic track lifter on page 61, the mechanized plate handling machine on page 66, the anchor tightening machine on page 105, and the spike setter-driver on page 106. Each of these machines are individually operated, self-propelled devices having their own undercarriages for supporting them on the railroad track.

In addition to the above-mentioned mechanized tie gang, other tie-renewal gangs are described on pages 28, 29 and 31 of "Railway Track and Structures", June 1978, and on pages 14 to 16 of the December 1968 issue of this publication. All of these known mechanized tie gangs are comprised of varying numbers of some 14 to 24 individual self-propelled machines, operating personnel being stationed between some of these machines for effectuating additionally required operating steps. The exchange of every third or fourth tie is effected with these known mechanized tie gangs by first removing the tie clips or anchors from the track, then pulling the spikes, removing the old tie plates, withdrawing every third or fourth tie, optionally sawing the withdrawn tie into chunks, placing the withdrawn ties or tie chunks on the track shoulder, scarifying the ballast, i.e. excavating it, in the areas of the track bed which supported the withdrawn ties, inserting new ties in these scarified track bed areas, the new ties having been conveyed to, or stored on, the track shoulder laterally adjacent these areas, whereupon new tie plates are inserted between the inserted new ties and the slightly raised railroad track rails, the new ties are tamped, new spikes are driven into the new ties to fasten the rails thereto, and the tie clips or anchors are applied again. In this connection, an independently operating tie plate distributor car, such as described and illustrated on pages 93 and 94 of "Progressive Railroading", March 1984, may be used for transporting and storing the old and new tie plates.

A tie renewal operation with the individual machines hereinabove described does not only require a large number of operators, including control and monitoring personnel, but also blocks long track sections and their neighboring tracks for a long time so that train traffic is interrupted for extended periods. The efficiency is low because it is exceedingly difficult to coordinate the operation of the many individual machines which are spaced from each other along the railroad track, causing numerous interruptions in the operation. In addition, if an attempt is made to pass some trains on a neighboring track even at low speed, the operators are exposed to danger. The mechanized tie gangs of the prior art, as exemplified hereinabove, does not produce accurate work since it is often difficult, if not impossible, properly to coordinate the operation of the individual machines and to align them exactly with the track line and level for their designated work.

Commonly assigned U.S. patent applications Ser. Nos. 97,757, 97,759 and 97,760, all filed Sept. 17, 1987, disclose a mobile tie replacement apparatus which comprises at least one elongated bridge-like work vehicle having two undercarriages supporting respective opposite ends of the work vehicle on the railroad track, and a succession of different individual devices mounted on the work vehicle or vehicles between the undercarriages and operative to effectuate different sequential operations for exchanging the selected old ties for the new ties. The present invention provides specific improvements in such an apparatus.

U.S. Pat. Nos. 4,175,902, dated Nov. 27, 1979, and No. 4,190,394, dated Feb. 26, 1980, disclose an apparatus and method for loading and unloading open top or gondola railroad cars for transport of the ties used in such a tie exchange operation. The apparatus comprises a train mounted for mobility along the railroad track and includes a plurality of the open top railroad cars having a considerable loading volume, adjacent ones of the railroad cars being coupled together and each railroad car having two high parallel side walls with top edges and two high end walls, the end walls of the adjacent railroad cars defining respective gaps therebetween, and a power-driven crane with booms for loading and unloading the ties and having two undercarriages supporting the crane for mobility in the direction of the railroad track. The undercarriages have pneumatic tires to enable the crane to be moved along a road or the railroad track, and the crane also has pivoted gliding feet or brackets for gripping the top edges, the relatively widely spaced top edges of the railroad cars serving as a track for moving the crane along the cars while the gliding feet grip the top edges. A cable is attached to the crane to pull the crane along the railroad cars as it is perched atop the cars. Operation of this apparatus requires great skill and a number of sometimes life-threatening manual steps. The movement of the crane between adjacent cars is particularly difficult and very time-consuming, which considerably reduces the efficiency of the operation. The crane movement along and between the cars is quite unstable, providing unsafe operating conditions and frequent interruptions. In addition, the tractor used for the crane must be specially designed to enable the crane to effectuate the required forward and rearward movements on the top edges of the gondola cars.

The old and new ties may be loaded, transported and unloaded at the same time or another time by a mobile loader and unloader installation of the first-described type. After the tie exchange has been completed, the ballast supporting the track may be regulated and shaped, and the track ties may be tamped, with a concomitant track correction, for example by means of a track tamping, leveling and lining machine of the type disclosed in U. S. Pat. No. 4,534,295, dated Aug. 13, 1985.

SUMMARY OF THE INVENTION

It is the primary object of the present invention to improve apparatus for sequentially exchanging selected consecutive groups of old ties, such as three ties at a time, for groups of new ties while retaining groups of old ties between the selected old ties for support of the mobile apparatus on the railroad track so that the withdrawal of the old ties from the track and the insertion of the new ties may be effected more efficiently, simply and safely.

The above and other objects are accomplished in accordance with this invention with a mobile apparatus which comprises at least one bridge-like work vehicle having a frame defining an upwardly recessed portion between respective ends thereof, and a succession of different individual devices mounted in the recessed frame portion of a respective work vehicle and operative to effectuate different sequential operations for exchanging the selected old ties for the new ties, the tie exchanging devices including at least two tie pulling and inserting devices arranged for longitudinal displacement within view of an operator's accommodation, which may be a cab mounted in the recessed work vehicle frame portion or an operator's seat mounted on the tie pulling and inserting device. A respective drive displaces each tie pulling and inserting device with respect to the work vehicle frame along a displacement path extending in the direction of the longitudinal extension of the work vehicle frame.

This surprisingly simple, yet advantageous, novel arrangement of the tie pulling and inserting devices on a single, common, continuously advancing installation substantially rationalizes the tie replacement operation. The longitudinally displaceable mounting of the two tie pulling and inserting devices on the bridge-like work vehicle enables the entire installation to be efficiently and continuously operated in the manner of a moving assembly line. During the short operating intervals when the tie pulling and inserting devices must be kept stationary, the operator can so control the longitudinal displacement drives of these devices that they are displaced relative to the work vehicle in a direction opposite to that of the vehicle advancement so that the tie replacement can be simply and rapidly effectuated without trouble while the apparatus proceeds non-stop, the devices in view of the operator's accommodation being longitudinally displaceably mounted in the recessed portion of the work vehicle frame. Furthermore, tie replacement may be effected in whole track sections at a time, which considerably increases the productivity and assures better control as compared to the operation of separately operated and independently movable individual tie exchanging devices. Mounting these individual devices on a common mobile apparatus also assures a more uniform and accurate track renewal. Since it is no longer necessary to equip each of the individual tie exchanging devices with their own drives, brakes and the like, the entire apparatus is much simpler and more economical, only longitudinal displacement drives being required for displacing the devices on the work vehicle and a common power source for these drives being available on the work vehicle.

The above and other objects, advantages and features of this invention will become more apparent from the following detailed description of certain now preferred embodiments thereof, taken in conjunction with the accompanying somewhat schematic drawing

DESCRIPTION OF THE PREFERRED EMBODIMENTS

Figures 1, 2, 3, 4:
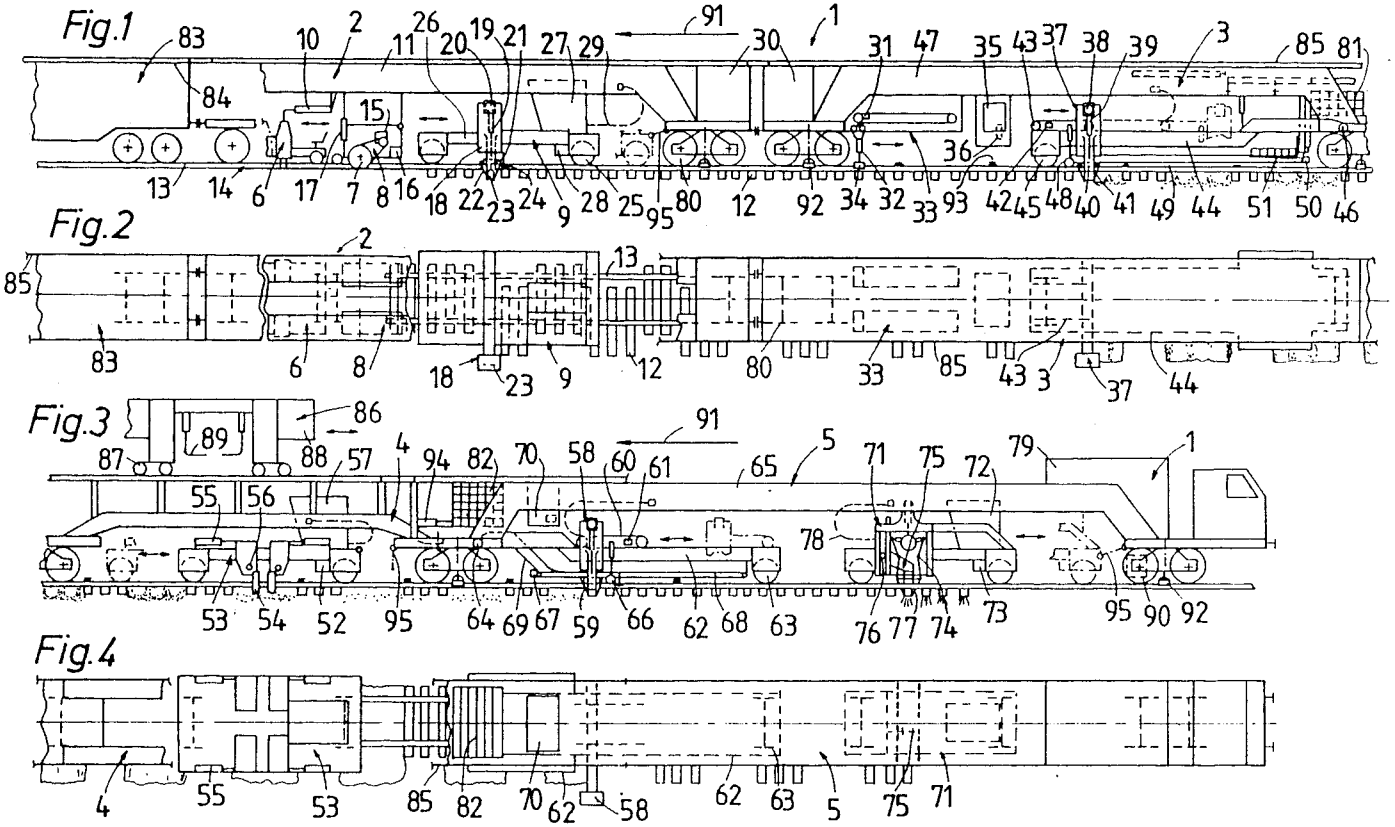
FIG. 1 is a side elevational view of the forward portion of a mobile apparatus according to one embodiment of the invention.
FIG. 2 is a top view of FIG. 1.
FIG. 3 is a side elevational view of the rear portion of the apparatus of this embodiment.
FIG. 4 is a top view of FIG. 3.

Referring now to the drawing and first to FIGS. 1 to 4, there is shown mobile apparatus 1 for sequentially exchanging selected consecutive groups of old ties 12 in existing railroad track 14 for groups of new ties while retaining groups of old ties therebetween to support the mobile apparatus on the track. The illustrated mobile apparatus comprises a succession of work vehicles coupled together, including leading work vehicle 2 followed by second, third and fourth work vehicles 3, 4 and 5, the coupled together work vehicles forming a train. Each bridge-like work vehicle has a frame 11 defining an upwardly recessed portion between respective ends thereof. A succession of different individual devices are mounted in the recessed portions of the work vehicle frames and are operative to effectuate different sequential operations for exchanging selected old ties 12 for the new ties, the tie exchanging devices including first tie pulling and inserting device 37 on work vehicle 3, which serves to pull selected old ties 12 and precedes second tie pulling and inserting device 58 on work vehicle 5, which serves to insert the new ties, the tie pulling and inserting devices being arranged for longitudinal displacement within view of an operator's accommodation illustrated in the present embodiment as operator's cabs 35 and 70 respectively mounted in the recessed frame portion of work vehicle 3 and 5. Respective drive 42 and 61 displaces tie pulling device 37 and tie inserting device 58 with respect to frame 11 of work vehicle 3 and 5 along a displacement path in the direction of the longitudinal extension of the work vehicle frame.

Drive means 90 (shown at the right in FIG. 3) continuously advances the train in an operating direction indicated by arrow 91 and swivel trucks 80 support the work vehicle frame ends on railroad track 14. First bridge-like work vehicle 2 precedes work vehicle 3 which leads trailing work vehicle 5 in the operating direction. The first work vehicle carries track-bound double-spike puller 6 longitudinally displaceably mounted in the recessed frame portion of the first work vehicle, track-bound spike collecting device 8 comprising magnetic drum 7 arranged to receive spikes pulled by the spike puller, the spike puller and spike collecting device having flanged wheels for rolling support on the track rails, and track-bound self-propelled ballast clearing device 9 longitudinally displaceably mounted in the recessed frame portion of work vehicle 2. A useful ballast clearing and planing machine for this purpose is specifically disclosed and claimed in a commonly assigned patent application filed simultaneously by Josef Theurer, Johann Hansmann and Herbert Worgotter, entitled "Mobile Ballast Clearing and Planing Machine".

A respective double-spike puller 6 is associated with each rail 13 for pulling spikes at both sides of the rail and has an operator's seat for controlling the spike pulling operation. Longitudinal displacement drive 10 connects spike puller 6 to machine frame 11 of work vehicle 2 for displacement in the upwardly recessed frame portion of the work vehicle above track 14. Magnetic drum 7 of spike collecting device 8 is rotatable counterclockwise by drive 15 and precedes a spike collecting receptable 16 for storing the spikes moved thereto by rotating drum 7. A vertical displacement drive 17 is connected to the magnetic drum for lifting the same off the track when apparatus 1 is moved between operating sites. Ballast clearing device 9 includes carriage 26 running on track 14 on flanged wheels 25 and propelled by drive 28, the carriage supporting operator's cab 27 and tie puller 18 which is vertically and transversely adjustable by respective drives 19 and 20. Tie clamping device 22 adjustable by drive 21 to grip a respective tie 12, ballast scarifying element 23 immersible in the ballast adjacent an end of the tie and lifting plate 24 are arranged at the lower end of tie puller 18. The drives of ballast scarifier 9 are hydraulically operated and receive their hydraulic power through flexible hoses 29 from central power supply 30.

An auxiliary carrier frame 44 is mounted in the recessed frame portion of leading bridge-like work vehicle 3, which follows first work vehicle 2, first tie pulling and inserting device 37, a vertical tie conveyor 48 and tie transporting device 49 being mounted on auxiliary carrier frame 44. The operator's accommodation is a cab 35 mounted in the recessed frame portion of leading work vehicle 3. One of the individual tie exchange devices is tie plate transporting device 33 mounted in the recessed frame portion of the leading work vehicle and preceding cab 35 within view thereof, the tie plate transporting device including drive means 31, 32 for lifting respective ones of the tie plates by magnet 34 and displacing the lifted tie plates longitudinally. The first tie pulling and inserting device succeeds operator's cab 35 and is within view thereof. It comprises drives 38 and 39 for raising and transversely displacing tie clamping device 41 operated by drive 40 for gripping a respective old tie 12. Tie pulling device 37 is supported on wheeled carriage 43 slidably mounted on auxiliary frame 44 and connected to longitudinal displacement drive 42 for longitudinally displacing the tie pulling device. Undercarriage 45 supports a forward end of auxiliary carrier frame 44 with flanged wheels on track rails 13 while the rear carrier frame end is linked to recessed frame 47 of work vehicle 3 by joint 46. Vertically adjustable holding clamp 48 is connected to wheeled carriage 43 and slidably grips the head of rail 13. The tie transporting device extends below auxiliary carrier frame 44 and therealong, this device being illustrated as an endless conveyor band mounted on the auxiliary carrier frame and driven by drive 50. Vertical tie conveyor 51 succeeds tie pulling device 37 and is connected at the rear end of auxiliary carrier frame 44 to machine frame 47 by a vertical drive.

Another auxiliary carrier frame 62 is mounted in the recessed frame portion of trailing bridge-like work vehicle 5, second tie pulling and inserting device 58, the associated vertical tie conveyor 69 and tie transporting device 68 being mounted on the other auxiliary carrier frame. The operator's accommodation is another cab 70 mounted in the recessed frame portion of the trailing work vehicle. In the same manner as described hereinabove in connection with leading work vehicle 3, tie inserting device 58 is supported on wheeled carriage 60 slidably mounted on auxiliary frame 62 and connected to longitudinal displacement drive 61 for longitudinally displacing the tie inserting device. Undercarriage 63 supports a rear end of auxiliary carrier frame 62 with flanged wheels on track rails 13 while the forward carrier frame end is linked to recessed frame 65 of work vehicle 5 by joint 64. Vertically adjustable holding clamp 66 is connected to wheeled carriage 60 and slidably grips the head of rail 13. The tie transporting device extends below auxiliary carrier frame 62 and therealong, this device being illustrated as an endless conveyor band mounted on the auxiliary carrier frame and driven by drive 67. Vertical tie conveyor 69 precedes tie inserting device 58 and is connected at the front end of auxiliary carrier frame 62 to machine frame 65. The arrangement of vertical tie conveyor 51 rearwardly of tie puller 37 and of vertical tie conveyor 69 in front of tie inserter 58 has the considerable advantage that the old ties may be stored on train 1 and the new ties may be supplied to the tie inserter directly from the train without the need of depositing the ties on the track shoulders.

As shown in FIGS. 3 and 4, self-propelled tie tamping device 71 is longitudinally displaceably mounted in the recessed frame portion of trailing bridge-like work vehicle 5 and succeeds the other auxiliary carrier frame 62 and a further operator's cab 72 is mounted in the recessed frame portion of the trailing bridge-like work vehicle, the tie tamping device preceding the further operator's cab. Tamping device 71 comprises a carrier frame running on front and rear undercarriages on the track and being propelled by drive 73, cab 72 being mounted on the carrier frame. The carrier frame also supports tamping heads 74 with vibratory and reciprocatory tamping tools arranged to be immersed in the ballast for tamping the same under the newly inserted ties. Tie positioning device 75 is associated with the tie tamping device and is arranged between the reciprocatory tie tamping tools. The tie positioning device is transversely displaceable on the carrier frame by drive 76 for suitably positioning the newly inserted ties. The tie positioning device is also connected to a vertically adjustable drive and has a tie gripping clamp at its lower end. Drive 73 and the operating drives of tie tamping device 71 are hydraulic drives connected by flexible hoses 78 to central power supply 79. A useful combined tie positioning and tamping machine has been disclosed and claimed in commonly assigned patent application filed by Josef Theurer and entitled "Ballast Tamping Machine".

As shown at the left in FIGS. 3 and 4, self-propelled device 53 for clearing and planing ballast serving to support the new ties and filling cribs therebetween is arranged between a rear one of the swivel trucks of leading work vehicle 3 and a front one of the swivel trucks of trailing work vehicle 5. A useful ballast clearing and planing machine for this purpose is specifically disclosed and claimed in a commonly assigned patent application filed simultaneously by Josef Theurer, Johann Hansmann and Herbert Worgotter, entitled "Mobile Ballast Clearing and Planing Machine". In the illustrated embodiment, this device is mounted in the upwardly recessed frame portion of third work vehicle 4, is propelled by drive 52 and includes further operator's cab 57. Device 53 runs on flanged wheels on the track rails and has two ballast clearing devices associated with each rail, each ballast clearing device 54 being connected to drives 55 and 56 for adjusting the devices longitudinally in the operating direction as well as transversely thereto. The operation of the ballast clearing and planing devices is controlled from cab 57. The drives are again hydraulically operated and connected by flexible hoses to a central power supply. The arrangement of ballast clearing and planing device 9 ahead of tie pulling device 18 and ballast clearing and planing device 53 ahead of tie inserting device 58 has the advantage of enabling the tie exchange to proceed trouble-free and more rapidly since it will facilitate the work of the stationary devices during the tie exchange operation before they are displaced longitudinally with respect to the respective work vehicle frame so that the speed of the continuous advance of train 1 may be increased.

As shown at the right in FIG. 1 and at the left in FIG. 3, storage space for stack 81 of the selected old ties and stack 82 of the new ties respectively is provided above the rear swivel truck of work vehicle 3 and the front swivel truck of work vehicle 5, more particularly at the points where the front and rear ends of third work vehicle 4 are pivotally coupled to the preceding and succeeding work vehicles, respectively. Each stack of ties may be comprised of six layers of seven ties each. As more specifically described in the previously mentioned copending patent applications, coupled work vehicles 2, 3, 4 and 5 form a train with preceding tie transporting car 83, which continuously advances in the operating direction indicated by arrow 91. The tie transporting car is an open-top freight car for loading the ties and had two parallel side walls with top edges 84 extending in the direction of railroad track 14 and continuous guide track 85 extends along the top edges of car 83 and the frames of the work vehicles. Power-driven crane 86 is movable along the guide track for transporting the ties. The crane has front and rear undercarriages each having pairs of flanged wheels 87 running on the rails of continuous guide track 85 and is propelled by drive 88 along the track. It is equipped with a pair of gripper arms 89 rotatable about a vertical axis and vertically adjustable for gripping and lifting stacks 81 and 82 of ties. Such a work train has the advantage of providing not only for the simple and rapid transportation and storage of the old and new ties in an efficient and independent operating unit which advances continuously during the tie exchange but allows the work to be organized more effectively and to enable tie exchange operations to be effected during shorter intervals between trains. The power-driven crane makes it possible to transport the old and new ties rapidly atop the work train without interfering with the work of the tie exchange devices mounted in the recessed frame portions of the work vehicles. The arrangement of a succession of work vehicles carrying various tie exchange devices for effectuating tie exchange operations in addition to withdrawing the old ties and inserting the new ties has the advantage that a variety of necessary tie exchange operations may be carried out simultaneously at different sites along the track while train 1 advances non-stop. This provides an assembly line tie exchange operation of high efficiency. Since each tie exchange device has its own longitudinal displacement drive for displacing the device during the non-stop advance of the train, the operator of each device can move the device within the recessed frame portion of a respective work vehicle as required by the prevailing operating conditions. This assures the highest efficiency combined with accuracy and uniformity of the tie exchange operation in a highly economical manner. For this purpose, commercially proven individual tie exchange devices may be used, and such devices may simply be equipped with longitudinal displacement drives for incorporation into the mobile apparatus of the present invention.

As shown at right in FIG. 3, drive 90 advanced train 1 non-stop in the operating direction indicated by arrow 91. To assure safe running of two-axled swivel trucks 80 on track rails 13, particularly when, for instance, groups of three successive ties are exchanged between groups of three retained ties, the swivel trucks are equipped with rail guide devices 92 which securely maintain the gage of track 14.

As shown at right in FIG. 1, a stack of collected tie plates resting on a retained old tie 12 is designated by reference numeral 93.

In FIG. 3, preferably hydraulically operated drive 94 is shown at the rear end of work vehicle 4 for movement against the lowest layer of stack 82 of new ties. Coupling rod 95 can be connected to tie tamper 71 at the rear end of work vehicle 5 to move the tamper wit the work vehicle when train 1 is moved from one operating site to another.

Tie exchange work train 1 illustrated in FIGS. 1 to 4 operates in the following manner:

Drive 90 is operated to advance train 1 to the operating site, open-top freight car 83 being loaded with new ties. When the operating site has been reached, operators are placed in the various operator's accommodations on work vehicles 2 to 5 for operation of the individual tie exchange devices while the train is advanced non-stop by drive 90 in an operating direction indicated by arrow 91. The operator on the operator's seat on double-spike puller 6 at each track rail 13 operates the spike pulling tools at the left and right of each rail to pull the spikes out of those old ties which are to be exchanged, for example of a group of three adjacent ties. While the spikes are pulled, drive 10 holds spike puller 6 stationary with respect to track 14. After all the spikes are pulled, longitudinal displacement drive 10 is operated to displace the spike puller to its forward end position with respect to frame 11 of work vehicle 2. In this end position, the spikes are pulled from a succeeding group of old ties. The pulled spikes are collected by operating drive 15 to rotate magnetic drum 7 and transport the magnetically held spikes to storage container 16.

Meanwhile, the operator in cab 27 on first work vehicle 2 operates the vertically adjustable ballast scarifier tools 23 of ballast clearing and planing device 9 to move the ballast away from the end of a respective old tie 12, or group of old ties. This facilitates gripping of the tie end by tie clamping device 22. Drive 20 is now operated to withdraw the tie, from which the spikes were previously pulled, laterally a distance of about one third the tie length. This partial tie withdrawal operation begins while the ballast clearing and planing device is in its forward end position where it is held stationary during the operation with respect to the track. Since train 1 continuously advances, however, ballast clearing and planing device 9 is continuously displaced rearwardly with respect to the work vehicle into the rear end position indicated in FIG. 1 in dash-dotted lines. In this end position, the ballast clearing and partial tie withdrawal operations have been completed. Drive 28 is now operated for the rapid forward displacement of ballast clearing and planing device 9 into the forward end position to be ready for the succeeding ballast clearing and partial tie withdrawal operation. To facilitate the partial withdrawal of the tie, the track rail in the range of the tie to be withdrawn is momentarily lifted by lifting plate 24.

At the front end of succeeding work vehicle 3, partially withdrawn old ties 12 are sensed by tie plate transport device 33 whose magnet 34 picks up the tie plates loosely lying on these ties. The collected tie plates are then deposited in a stack 93 on next tie 12 retained in track 14. The operator in cab 35 with control panel 36 operates tie plate transport device 33 as well as succeeding tie puller 37. The tie puller has tie gripping tool 41 for gripping the end of each partially withdrawn tie to pull the tie completely out of track 14 by operation of lateral displacement drive 38. Again, tie pulling device 37 remains stationary with respect to track 14 during each tie pulling operation while auxiliary carrier frame 44, which supports the tie pulling device, advances continuously on undercarriage 45 with train 1. Each completely withdrawn tie 12 is lifted onto tie conveyor 49 by vertically adjusting tie gripping tool 41 by drive 39. The tie conveyor transports the old ties to vertical tie conveyor 51. This may be a fork lift arranged, for example, to receive a layer of six ties, after which it is raised to deposit the layer of ties on stack 81 of old ties. To prevent undercarriage 45 from being lifted off track 14 during the tie withdrawal operation, auxiliary carrier frame 44 is held on the track by clamping device 48 which glidably grips the rail head. After tie puller 37 has reached its rear end position indicated in dash-dotted lines in FIG. 1, at which point the tie pulling operation has been completed, it is rapidly advanced to its forward end position by operation of longitudinal displacement drive 42. In this end position, the following tie pulling operation commences.

The ballast in the section of the track bed from which old ties 12 have been withdrawn is smoothed or planed by ballast clearing and planing device 53 carried by work vehicle 4. For this purpose, shovel-shaped ballast clearing elements 54 are transversely and longitudinally displaced by operation of drives 55, 56 to displace the ballast towards the track shoulders. This operation is controlled by an operator in cab 57 and, after the ballast clearing and planing operation has been completed, device 53 is displaced into its forward end position shown in dash-dotted lines in FIG. 3 by operation of drive 52. The following ballast clearing and planing operation is then effected in this position.

The insertion of the new ties is effected by tie inserter 58 at the front end of work vehicle 5 (see FIG. 3). For this purpose, drive 94 is actuated to push a new tie from stack 82 to the vertical conveyor 69 which is a chute slidingly conveying the new tie to tie transport device 68 where tie gripping device 59 of the tie inserter grips the tie and inserts it laterally into the track. During the tie inserting operation, tie inserter 58 moves relatively to auxiliary carrier frame 62, i.e. it remains stationary with respect to the track. As soon as the tie inserter has reached its rear end position, indicated in dash-dotted lines in FIG. 3, the operator in cab 70 actuates drive 61 to displace the entire tie inserting device with its sliding carriage 60 longitudinally in its front end position shown in full lines. Meanwhile, the next new tie has been moved from stack 82 to tie transporting device 68 so that this tie is ready for insertion. To increase the efficiency of the tie inserting operation, the new ties are inserted into the track only about two thirds of their length, analogously to the tie withdrawal operation with device 18 described hereinabove in connection with FIG. 1. Also analogously to that operation, the new tie is fully inserted by tie positioning device 75 which grips the partially inserted tie and pushes it into the track by actuation of transverse drive 76, any ballast on the tie being removed therefrom as the tie slides under the rails. As soon as the new tie is in its proper position, ballast is tamped under it by tamping device 71 as the tamping device moves relatively to continuously advancing work vehicle 5, i.e. remains stationary with respect to the track. As soon as the tamping device has reached its rear end position, indicated by dash-dotted lines in FIG. 3, the operator in cab 72 actuates drive 73 to move it rapidly back into the front end position indicated in full lines. In this position, the next tie positioning and tamping operation is performed. When the train moves from one operating site to another, tamping device 71 is connected to machine frame 65 of work vehicle 5 by means of coupling rod 95 (shown in dash-dotted lines) to move the tamping device with the work vehicle. The same temporary coupling to work vehicles 2 and 4, respectively, is provided for ballast clearing and planing devices 9 and 53.

While train 1 advances non-stop along the operating site and independently of the operation of the individual tie exchange devices described hereinabove, motor crane 86 transports stacks 81 of old ties along guide track 85 to tie transport car 83 atop the train. Immediately after a stack of old ties is deposited in the transport car, a stack 82 of new ties is gripped by gripper arms 89 of the crane and is transported to the storage space provided between third and fourth work vehicles 4 and 5.

Another embodiment is illustrated by train 96 in FIGS. 5 to 8, the train comprising four successive and coupled work vehicles 97, 98, 99 and 100 preceded by tie transport car 100. The train moves continuously in an operating direction indicated by arrow 102 along track 106 consisting of rails 105 fastened to ties 104. The ends of the bridge-like work vehicles are supported on the track by double-axles swivel trucks 103.

As shown in the drawing, one of the tie exchange devices in this embodiment is track-bound spike puller 107 longitudinally displaceably mounted in a recessed portion of frame 109 of first bridge-like work vehicle 97 and running on flanged wheels on track 106, drive 108 connecting the spike puller to frame 109 for longitudinal displacement thereof. Track-bound spike collecting device 111 comprising magnetic drum 110 and constructed like the spike collecting device in the previously described embodiment is arranged in the recessed frame portion of the first work vehicle immediately behind the spike puller to receive spikes pulled by the spike puller. Track-bound self-propelled ballast clearing or scarifying device 112 is also longitudinally displaceably mounted in the recessed frame portion of the first work vehicle. The ballast clearing device includes an operator's seat or cab, a tie extractor 113 effective to clear the ballast to the shoulders of the track and a track lifting mechanism 114. The tie extractor comprises tools longitudinally and transversely displaceably mounted on carriage 115. A drive is connected to ballast clearing device 112 for longitudinal displacement thereof.

Another individual tie exchange device constituted by tie plate transporting device 118 is mounted in the recessed portion of frame 119 of second work vehicle 98 and includes longitudinal displacement and lifting drive means 116, 117 for lifting respective ones of the tie plates. Two tie pulling and inserting devices 120, 121 immediately adjacent each other in the operating direction and serving to pull the selected old ties are mounted in the recessed frame portion of the second work vehicle. The tie pulling devices are suspended in the recessed frame portion by flanged rollers running on guide tracks and are connected to drives 122 for longitudinal displacement. Each tie pulling device comprises tie clamping device 123 arranged intermediate two lifting plates 124 engageable with the rail head and vertically adjustably mounted on frame 125. The operator's accommodation is an operator's seat on the tie pulling device frame. Vertical tie conveyor 126 is mounted in the recessed frame portion of second work vehicle 98 succeeding the tie pulling devices at the rear end of this vehicle and comprises an endless conveyor chain 127 driven by drive 128.

Figures 5, 6, 7, 8:
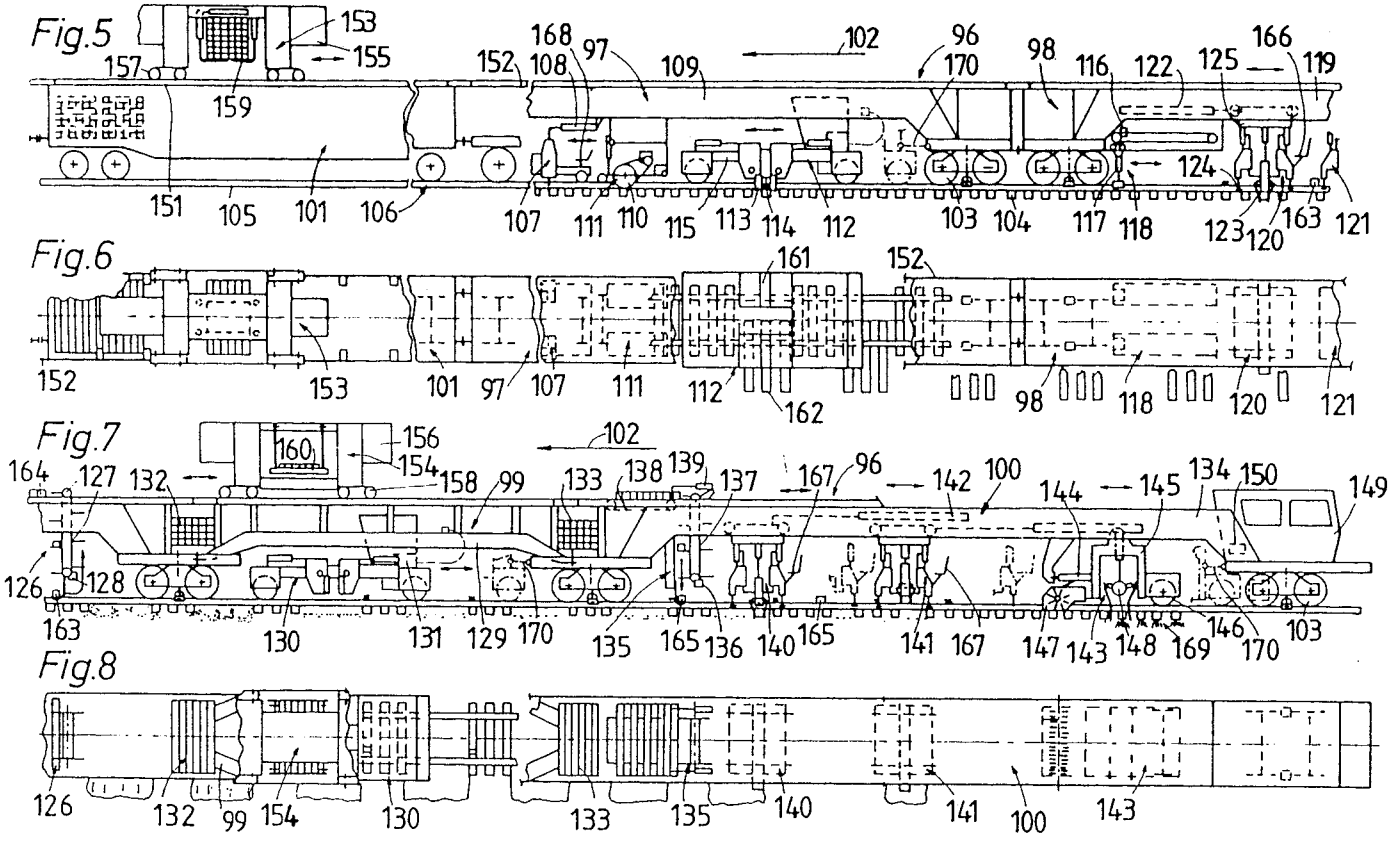
FIG. 5 is a side elevational view of the forward portion of a mobile apparatus according to another embodiment of the invention.
FIG. 6 is a top view of FIG. 5.
FIG. 7 is a side elevational view of the rear portion of the apparatus of this other embodiment.
FIG. 8 is a top view of FIG. 7.

As shown in FIG. 7, two like tie pulling and inserting devices 140, 141 serving to insert the new ties and a like vertical tie conveyor 135 preceding the same are mounted in the recessed portion of frame 134 of fourth work vehicle 100, the operator's accommodation being an operator's seat 167 on each tie inserting device. The vertical tie conveyor comprises conveyor chain 137 driven by drive 136 and conveyor band 138 is arranged between stack 133 of new ties and vertical tie conveyor 135, a longitudinally displaceable tie gripping device 139 being associated with the conveyor band to grip and move each new tie to the vertical tie conveyor. Each tie inserting device is connected by drive 142 to frame 134 of the fourth work vehicle for longitudinal displacement of the tie inserting device relative thereto.

Self-propelled tie tamping device 143 is also longitudinally displaceably mounted in the recessed frame portion of the fourth bridge-like work vehicle and succeeds tie inserting device 141. Drive 144 connects the tie tamping device to frame 134 of work vehicle 100 for longitudinal displacement of the tie tamping device relative to the work vehicle frame and undercarriage 146 supports a rear end of frame 145 of the tie tamping device on the track. The tie tamping device comprises ballast sweeping brush 147 which is vertically adjustably mounted at the front end of tamping device frame 145 and tamping units 148 are vertically adjustably mounted on the frame for immersion in the ballast adjacent the respective track rails. Further operator's cab 149 is mounted on frame 134 of bridge-like work vehicle 100, the tie tamping device immediately preceding the further operator's cab. Cab 149 holds the central drive control for the train and a control 150 for tie tamping device 143, the train drive being located on rear swivel truck 103.

As shown at the left in FIG. 7, a third bridge-like work vehicle 99 has the respective ends of upwardly recessed frame 129 supported on a rear swivel truck of second work vehicle 98 and a front swivel truck of fourth work vehicle 100. Self-propelled device 130 for clearing and planing ballast serving to support the new ties and filling cribs therebetween is mounted on the third work vehicle, this device being like device 53 described in connection with FIG. 3, the drives being preferably powered by Diesel motor 131 or from a central power plant on the train. A respective storage space for stack 132 of the selected old ties and of stack 133 of the new ties is arranged above the rear and front swivel trucks.

This arrangement increases the efficiency of the tie exchange operation by providing pairs of tie pulling and inserting devices for pulling the selected old ties and inserting the new ties while the mobile apparatus advances non-stop. In this apparatus, too, it is possible to use commercially successful individual tie exchange devices, such as spike pullers and spike collecting devices, ballast scarifiers and tie pullers and inserters, for the respective operations.

As in the first-described embodiment, continuous track 152 extends along top edges 151 of open-top tie transport car 101 and of the succeeding work vehicles of train 96 and two motor cranes 153, 154 respectively propelled by drives 155, 156 are supported on the rails of track 152 by front and rear undercarriages each having two flanged wheels engaging each track rail. Front motor crane 153 is equipped with vertically adjustable gripper arms 159 rotatable about a vertical axis for transporting a stack 132, 133 of ties. Rear motor crane 156 is equipped with two L-shaped retaining ledges 160 spaced from each other by a distance corresponding to the length of the ties for holding several, for example six, ties, the tie retaining ledges being pivotal towards and away from each other transversely to the elongation of the apparatus for respectively gripping and releasing the ties.

The operation of train 96 will partly be obvious from the above description of its structure and will now be described in detail:

As explained in connection with the embodiment of FIGS. 1 to 4, the spikes are respectively pulled from the selected old ties and collected by devices 107 and 111 on first work vehicle 97. The ballast is cleared at the ends of the selected old ties and in an adjacent area of the track shoulder by ballast clearing and planing tools 113 of device 112 and rail 105 is then slightly lifted by track lifting device 114 so that tie 104 to be exchanged may be slid out of track 106 by hook-shaped tie extractor 161 which is transversely displaceable (see FIG. 6). At this point, tie 104 is transversely displaced a distance corresponding to about one third to one half of the tie length. Preferably, a group 162 of adjacent ties 104 is so displaced. In the same manner as described in connection with the embodiment of FIGS. 1 to 4, the loosened tie plates are received and stored by tie plate transporting device 118 on second work vehicle 98.

As train 96 continues to advance, the partially pulled old ties are gripped by clamping device 123 of tie pullers 120 and 121 and are completely pulled out of track 106 and placed on the track, as shown at 163 in FIG. 5. As in the operation of all the individual tie exchange devices, tie pullers 120, 121 are displaced longitudinally relative to the frame of the work vehicle during their operation, i.e. they remain stationary with respect to track 106. Also, after their operation has been completed, the operator within whose view the tie exchange device is arranged actuates the longitudinal displacement drive connected thereto to return the tie exchange device to its front end position. Old ties 163, which have been successively placed on track 106, are received on vertical tie conveyor 126 and lifted to storage space 164 on frame 119 of second work vehicle 98. As soon as a layer of, say, six old ties has been placed in storage space 164, retaining ledges 160 of motor crane 156 are pivoted towards each other to grip the ends of the ties and the crane is moved to deposit this layer of old ties on stack 132.

Also similarly to the operation of the embodiment of FIGS. 1 to 4, the ballast area from which the old ties have been removed is cleared and planed by device 130 on third work vehicle 99. Vertical tie conveyor 135 then lays new ties 165 on track 106 where they are gripped by the clamping tools of tie inserters 140, 141 and are inserted into track 106 while lifting plates 124 slightly raise track rails 105 to facilitate the sliding of the new ties under the track rails. Again, the operator on seats 167 controls the operation of the tie inserters. Tie tamping device 143 may be coupled to fourth work vehicle 100 by rods 170 when the train is moved from one operating site to another. Like temporary coupling rods are provided for ballast scarifiers 112 and 130.

Finally, group 169 of new ties is tamped by tie tamping device 148, rotatable ballast brush 147 cleaning any ballast off the new ties. In a succeeding operating stage, new ties 165 are fastened to rails 105.

What is claimed is;

1. A mobile apparatus for sequentially exchanging selected consecutive groups of old ties in an existing railroad track for groups of new ties while retaining groups of old ties therebetween to support the mobile apparatus on the track, which comprises (a) at least one bridge-like work vehicle having a frame defining an upwardly recessed portion between respective ends thereof (b) a drive for the continuous advancement of the work vehicle on the railroad track in an operating direction, a succession of individual devices operative to effectuate different sequential operations for exchanging the selected old ties for the new ties, the tie exchanging devices including (1) at least two tie pulling and inserting devices having tie gripping means for gripping an end of the ties laterally projecting from the track and for respectively pulling the old ties laterally out of, and inserting the new ties laterally into, the track, the devices being mounted for longitudinal displacement in the recessed frame portion of a respective work vehicle within view of an operator's accommodation, and (d) a respective drive for displacing each tie pulling and inserting device with respect to the respective work vehicle frame along a displacement path extending in the direction of the longitudinal extension of the work vehicle frame.

2. The mobile apparatus of claim 1, wherein the operator's accommodation is a cab mounted in the recessed work vehicle frame portion.

3. The mobile apparatus of claim 1, comprising a succession of said work vehicles coupled together and mounting respective ones of said individual tie exchange operating devices.

4. The mobile apparatus for sequentially exchanging selected consecutive groups of old ties in an existing railroad track for groups of new ties while retaining groups of old ties therebetween to support the mobile apparatus on the track, which comprises (a) a succession of bridge-like work vehicles coupled together to form a train including a first, second, third and fourth work vehicle, each work vehicle having (1) a frame defining an upwardly recessed portion between respective ends thereof, (b) swivel trucks supporting the work vehicle frame ends on the railroad track, (1) the third work vehicle having the respective frame ends thereof supported on a rear one of the swivel trucks of the second work vehicle and a front one of the swivel trucks of the fourth vehicle, (c) a continuous guide track extending atop the work vehicle frames, (d) a power-driven crane movable along the guide track for transporting the ties, (e) a drive for the continuous advancement of the train on the railroad track in an operating direction, (f) a succession of individual devices operative to effectuate different sequential operations for exchanging the selected old ties for the new ties, the tie exchanging devices being mounted for longitudinal displacement and including (1) first and second tie pulling and inserting devices mounted within view of an operator's accommodation in the recessed frame portion of the second and fourth work vehicle, respectively, and having tie gripping means for gripping an end of the ties laterally projecting from the track, the first device pulling the selected old ties laterally out of the track and the second device inserting the new ties laterally into the track, (2) a track-bound spike puller mounted in the recessed frame portion of the first work vehicle, (3) a tie plate transporting device mounted in the recessed frame portion of the second work vehicle, the tie plate transporting device including drive means for lifting respective ones of the tie plates, (g) a respective drive for displacing each tie exchanging device with respect to the respective work vehicle frame along a displacement path extending in the direction of the longitudinal extension of the work vehicle frame, (h) a respective vertical tie conceyor associated with each of the first and second tie pulling and inserting devices, (i) a track-bound spike collecting device arranged in the recessed frame portion of the first work vehicle to receive spikes pulled by the spike puller, (j) a track-bound self-propelled ballast clearing device longitudinally displaceably mounted in the recessed frame portion of the first work vehicle, the ballast clearing device including an operator's cab, a tie extractor and a track lifting mechanism, (k) a self-propelled tie tamping device longitudinally displaceably mounted in the recessed frame portion of the fourth bridge-like work vehicle and succeeding the tie inserting device, the tie tamping device comprising a ballast sweeping brush, (l) a further operator's cab on the fourth bridge-like work vehicle, the tie tamping device preceding the further operator's cab, (m) a self-propelled device for clearing and planing ballast serving to support the new tires and filling cribs therebetween, the ballast clearing and planing device being mounted on the third work vehicle, and (n) a storage space for the selected old ties and the new ties respectively above the rear and front swivel trucks.

* * * * *